US005923246A

United States Patent [19]

Hartsfield

[11] Patent Number: 5,923,246

[45] **Date of Patent: *Jul. 13, 1999**

[54] CODE READING DEVICE

[75] Inventor: David K. Hartsfield, Streetsboro, Ohio

[73] Assignee: Channel Products, Inc., Chesterland, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/539,719

[22] Filed: Oct. 5, 1995

[51] Int. Cl.[6] ..... G08B 23/00

[52] U.S. Cl. ..... 340/501; 340/500; 340/525; 340/825.16; 340/825.17; 340/577; 340/518; 340/517

[58] Field of Search ..... 340/501, 506, 340/500, 555, 531, 825.72, 825.16, 825.17, 825.18, 525, 517, 518, 577; 359/109, 110, 143, 144; 235/375, 385

[56] References Cited

U.S. PATENT DOCUMENTS 3,922,664 11/1975 Wadsworth ..... 340/517
4,622,540 11/1986 Guscott et al. ..... 340/531
4,626,832 12/1986 Farrington et al. ..... 340/501
4,644,266 2/1987 Reuter ..... 431/13
4,842,510 6/1989 Grunden et al. ..... 431/20
4,941,201 7/1990 Davis ..... 340/870.16
5,307,050 4/1994 Patton et al. ..... 340/500

*Primary Examiner*—Donnie L. Crosland
*Attorney, Agent, or Firm*—James A. Hudak

[57] ABSTRACT

A controller which controls the operation of the solenoid valve that regulates the flow of gas to the burner within a fuel-gas fired burner system is disclosed. The controller performs a number of diagnostic tests on the system components and provides an output in the form of a series of pulses having a specific code"embedded" therein to identify a fault condition when it occurs. The series of pulses is applied to a light emitting diode. A code reading device having an optical sensor and a liquid crystal display is provided to intercept the light pulses emitted by the light emitting diode and to"translate" the code embedded therein so that the specific fault condition can be identified and displayed on the liquid crystal display.

4 Claims, 5 Drawing Sheets

CODE READING DEVICE

TECHNICAL FIELD

The present invention relates, in general, to a device for monitoring and diagnosing fault conditions within a fuel-gas fired burner system and, more particularly, to a device that provides a visual "read-out" identifying the specific fault condition when a fault occurs.

BACKGROUND ART

Various devices are presently available for identifying fault conditions in a fuel-gas fired burner system. For example, the controllers for such systems might include a plurality of light emitting diodes, which might be mounted on a printed circuit board located within a controller or on a control panel positioned adjacent to or located remotely from the controller. If a fault condition occurs resulting from the improper operation of one of the system components, a light emitting diode is illuminated, thus indicating to the appliance owner or the service man that a component within the system is not operating properly. This approach can prove to be dangerous since it can encourage the appliance owner to attempt to service the system himself. Since most appliance owners are inexperienced with respect to the operation of fuel-gas fired burner systems, such appliance owners, in an attempt to correct a fault condition, might electrically and/or mechanically bypass a safety device within the system, thus creating a very dangerous condition.

Other fault indicating approaches utilize terminals or "read-outs" on a control panel permitting a service man to attach diagnostic equipment to same to determine the cause of the fault condition. An inherent disadvantage of this latter approach is that the fault conditions are typically pre-selected by the controller manufacturer and cannot be "customized" for a specific application. In addition, physical connections must be made by the service man to the terminals or "read-outs" on the controller in order to identify the fault conditions.

In view of the foregoing disadvantages associated with the prior art approaches to identifying fault conditions within a fuel-gas fired burner system, it has become desirable to develop a system having fault indicating capabilities and comprising a controller which produces a plurality of fault indicating outputs from a single light emitting diode, each output indicative of a specific fault condition, and a "reading" device which deciphers each output and provides a visual "read-out" identifying the specific fault condition.

SUMMARY OF THE INVENTION

The present invention overcomes the problems associated with the prior art and other problems by providing a controller which controls the operation of the solenoid valve which regulates the flow of gas to the burner within a fuel-gas fired burner system. In addition to regulating the operating phases of the burner and/or system, the controller performs a number of diagnostic tests on the components within the system and provides an output in the form of a series of pulses applied to a light emitting diode when a fault condition occurs. Each individual fault condition has a specific code "embedded" in the series of pulses applied to the light emitting diode so that the specific fault can be identified. A code reading device, including an optical sensor, a micro-processor and a liquid crystal display, is provided to intercept the light pulses emitted by the light emitting diode and to "translate" the code embedded therein so that the specific fault condition can be identified and visually displayed on the liquid crystal display.

DESCRIPTION OF THE PREFERRED EMBODIMENT

Figure 1:
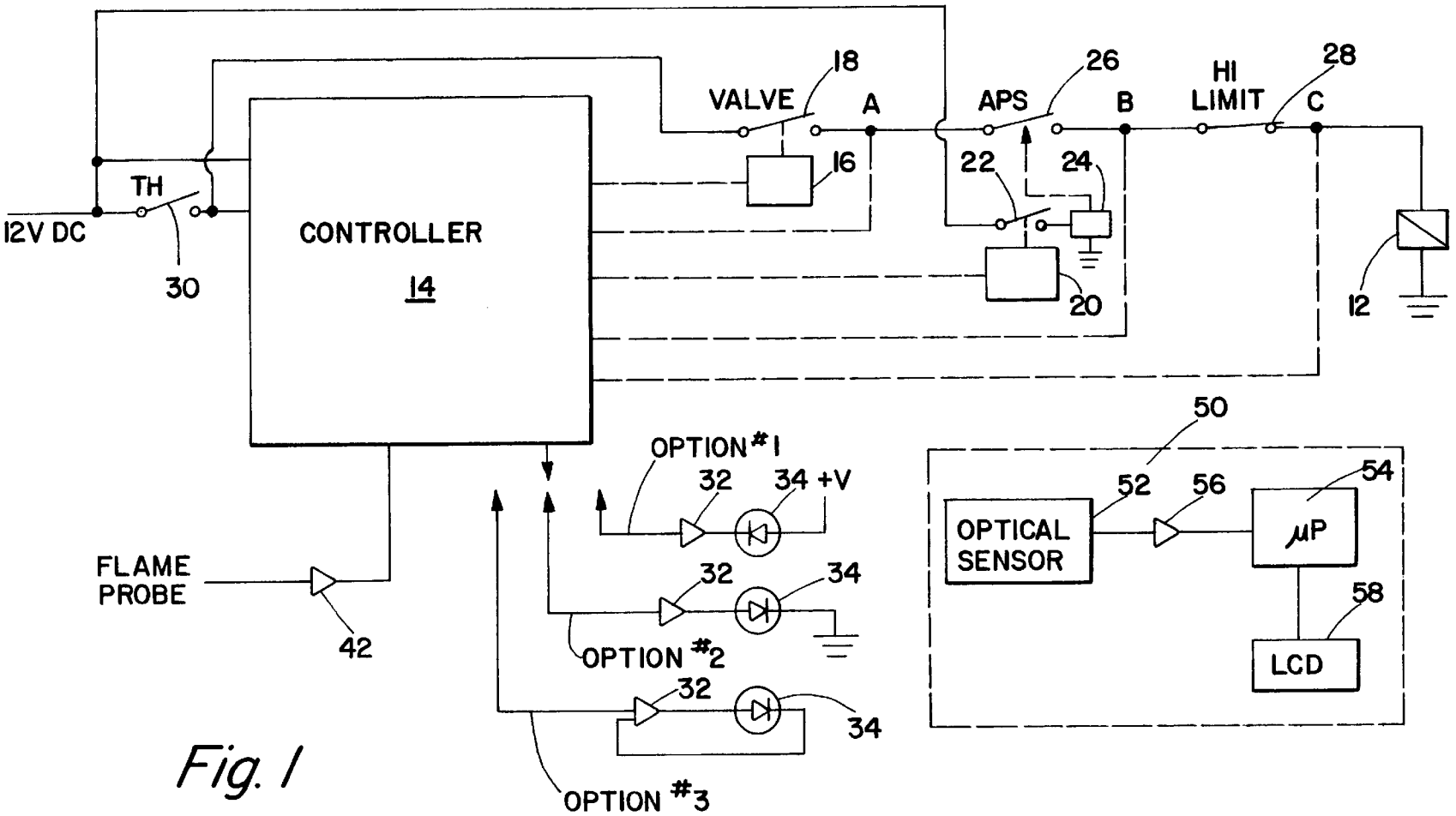
FIG. 1 is a schematic diagram of an electrical circuit utilized by the present invention.

Referring now to the drawings where the illustrations are for the purpose of describing the preferred embodiment of the present invention and are not intended to limit the invention described herein, FIG. 1 is a schematic diagram of an electrical circuit 10 which can be utilized to control the operation of a solenoid valve 12 that regulates the flow of gas to a burner (not shown). The burner can be installed in any type of gas-fired appliance or device, such as a furnace, stove, hot water heater, or the like. Electrical circuit 10 also includes a controller 14, a valve relay 16 with an associated normally open contact 18, a relay 20 with an associated normally open contact 22 which controls the application of power to a fan 24 that provides combustion air to the burner, a normally open air proving switch 26 actuatable by the flow of combustion air caused by the fan 24, and a normally closed high temperature limit switch 28. Valve contact 18, air proving switch 26 and normally closed high temperature limit switch 28 are electrically connected in series and interconnect a power supply, such as a 12 volts D.C. supply, through a thermostat contact 30 with the input to solenoid valve 12. Another output of controller 14 is connected to an amplifier 32 whose output is connected to the cathode of a light emitting diode 34 and whose anode is connected to a positive voltage V, shown as Option #1. Alternatively, the output of controller 14 can be connected as shown as Option No. 2 wherein the output of amplifier 32 is connected to the anode of light emitting diode 34 whose cathode is connected to ground. In another approach, the output of controller 14 is connected as shown as Option No. 3 wherein the output of differential amplifier 32 is connected across the anode of light emitting diode 34.

The inputs to controller 14 include the previously mentioned 12 volt D.C. power supply connected to the controller 14, via a buffer (not shown), and also connected to the controller 14 through thermostat contact 30. The output of a flame probe which determines the presence of flame at the burner is applied to another input to the controller 14 via an amplifier 42. In operation, when valve contact 18 and air proving switch 26 are closed and high temperature limit switch 28 is in the normally closed position, power is supplied to the solenoid valve 12, energizing same. As long as the high temperature limit switch 28 remains closed, power continues to be applied to the solenoid valve 12. When the valve contact 18 or the air proving switch 26 opens, power is interrupted to the solenoid valve 12, de-energizing same.

A hand-held, battery powered code "reading" device 50 is provided and is comprised of an optical sensor 52 whose output is connected to the input to a microprocessor 54 through an amplifier 56. The output of the microprocessor 54 is connected to a liquid crystal display 58. The light produced by light emitting diode 34 is detected by optical sensor 52, amplified by amplifier 56 and processed by microprocessor 54 to provide a visual output on liquid crystal display 58, as hereinafter described.

Controller 14 is utilized to provide a specific operating sequence to the burner (not shown) and to monitor various points, such as points A, B, or C, within the system to determine the status of the components therein. Such an operating sequence is usually comprised of a series of operating phases which can include a stand-by phase, a purge phase, a trial for ignition phase, a run phase and a post-purge phase. During the stand-by phase of operation, the controller 14 performs a series of diagnostic tests to verify that the overall system is in working order. When thermostat contact 30 closes indicating that the system is "calling" for heat, the controller 14 initiates the purge phase of operation wherein the system is purged for a pre-determined period of time. During the purge phase, the controller 14 actuates relay 20 causing its associated contact 22 to close resulting in the application of power to the fan 24 which provides combustion air to the burner causing the normally open air proving switch 26 to close. At the end of the purge phase, the controller 14 actuates relay 16 causing its associated contact 18 to close resulting in the application of power to the solenoid valve 12 initiating the trial for ignition phase of operation for a pre-determined period of time. Upon sensing ignition of the burner, i.e., the presence of a flame at the burner by the flame probe, the controller 14 enters the run phase of operation. When the system reaches the desired temperature, the thermostat contact 30 opens causing the controller 14 to de-energize valve relay 16 resulting in the opening of its associated contact 18 causing the de-energization of solenoid valve 12. The controller 14 then initiates the post-purge phase of operation for a pre-determined period of time.

During the stand-by phase of operation, the diagnostic tests performed by the controller 14 verify that:

a) The solenoid valve 12 is properly connected in the circuit 10;

b) The high temperature limit switch 28 is closed;

c) The valve relay contact 18 is not welded together in the normally open position; and d) The air proving switch 26 is in the open or "no flow" position.

During the purge phase of operation, the controller 14 permits power to be applied to the fan 24 that provides combustion air to the burner, begins the purge cycle for a pre-determined period of time, and verifies that:

a) The air proving switch 26 is in the closed or "flow" position within a pre-determined period of time after the start of the purge phase;

b) The high temperature limit switch 28 is closed;

c) A flame is not present at the burner; and d) Power is not being applied to the solenoid valve 12.

At the end of the purge phase, the controller 14 permits power to be applied to the solenoid valve 12 and initiates the trial for ignition phase of operation which lasts for a pre-determined period of time, such as seven (7) seconds. During the trial for ignition phase, a spark generator (not shown) is energized for a pre-determined period of time, such as 5.5 seconds, to ignite the gas emanating from the burner. After the expiration of this 5.5 second period of time, the spark generator becomes de-energized and the controller 14 checks for the presence of flame at the burner during the remaining 1.5 second time period. Upon sensing the presence of a flame at the burner, the controller 14 initiates the run phase of operation. During the run phase, the solenoid valve 12 remains energized, the presence of the flame at the burner is continuously monitored, and the controller 14 verifies that:

a) The high temperature limit switch 28 remains closed;

b) The air proving switch 26 remains in the closed or the "flow" position; and c) The solenoid valve 12 remains energized.

When the desired temperature has been reached, the thermostat contact 30 opens causing the controller 14 to de-energize valve relay 16 resulting in the opening of its associated contact 18 and the de-energization of solenoid valve 12. The controller then initiates the post-purge phase of operation causing the fan 24 that provides combustion air to remain "on" for a predetermined period of time, such as fifteen (15) seconds. During the post-purge phase, the controller 14 verifies that:

a) The air proving switch 26 is in the closed or "flow" position;

b) The high temperature limit switch 28 is closed;

c) A flame is not present at the burner; and d) The solenoid valve 12 is de-energized.

After the completion of the post-purge phase, the controller 14 returns to the stand-by phase of operation.

Figure 2:
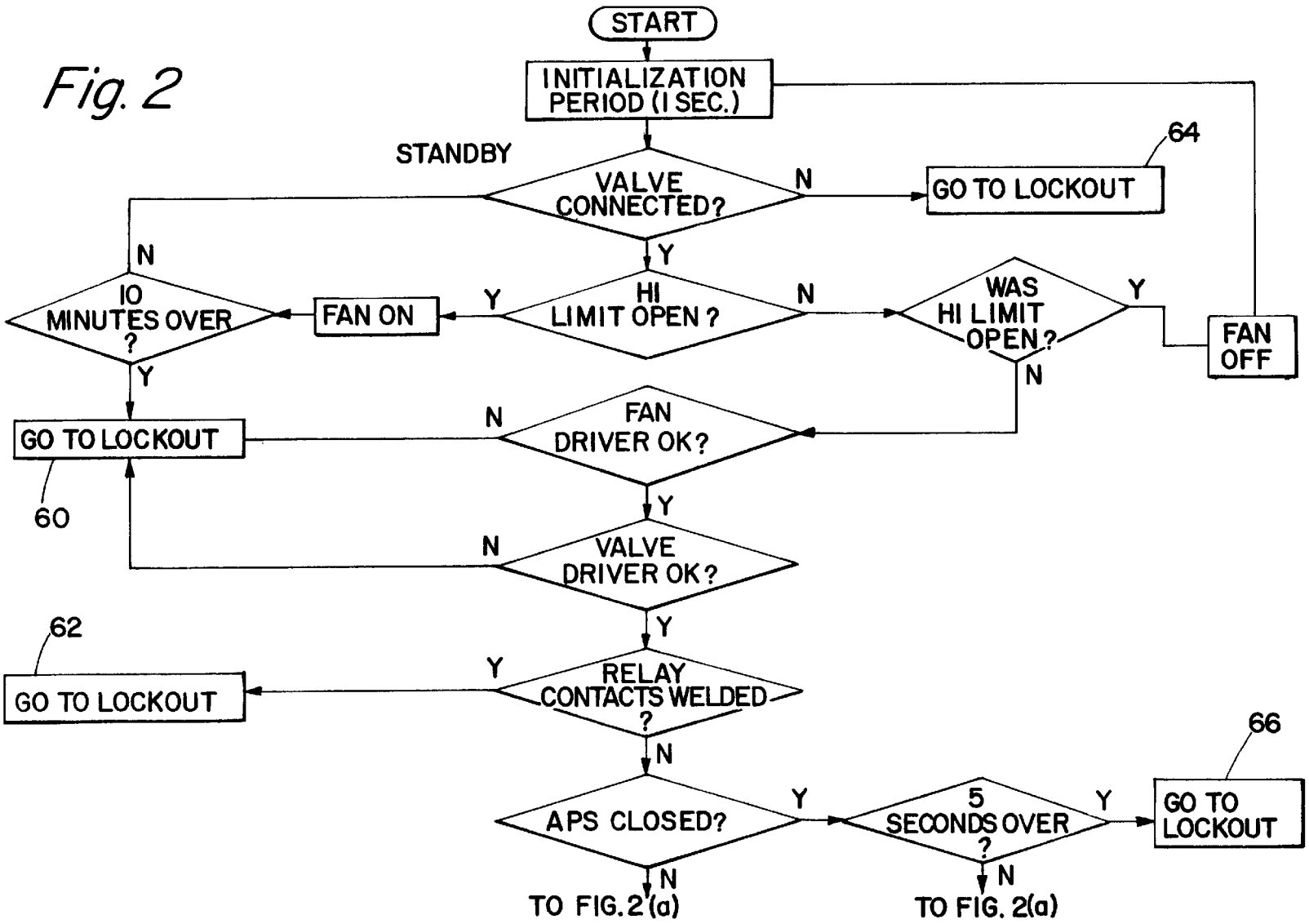
FIG. 2 and 2*a* is a flow chart illustrating the various phases of controller operation and lockout conditions which can occur in a typical fuel-gas fired burner installation.
Figure 2A:
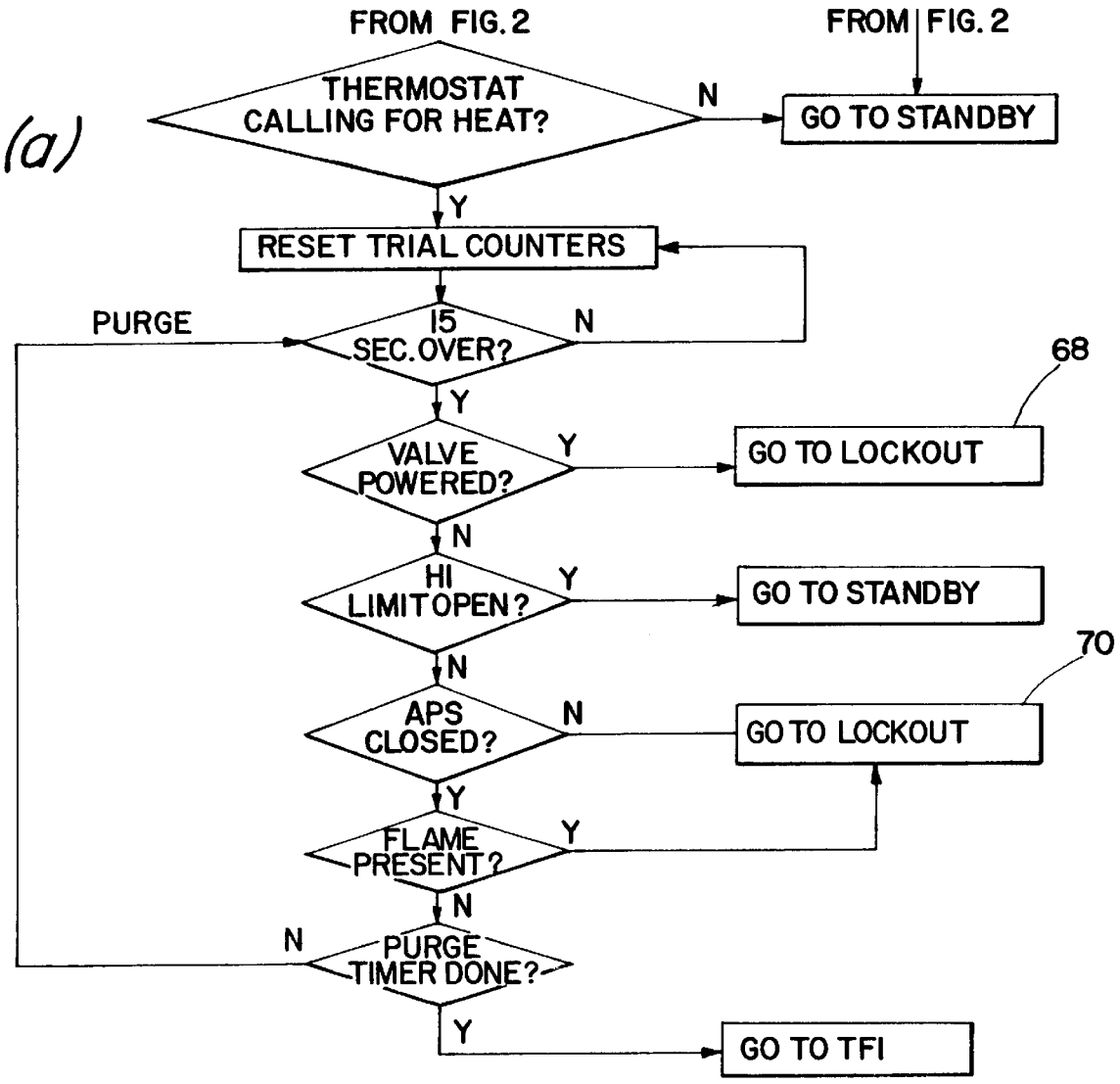
Figure 2B:
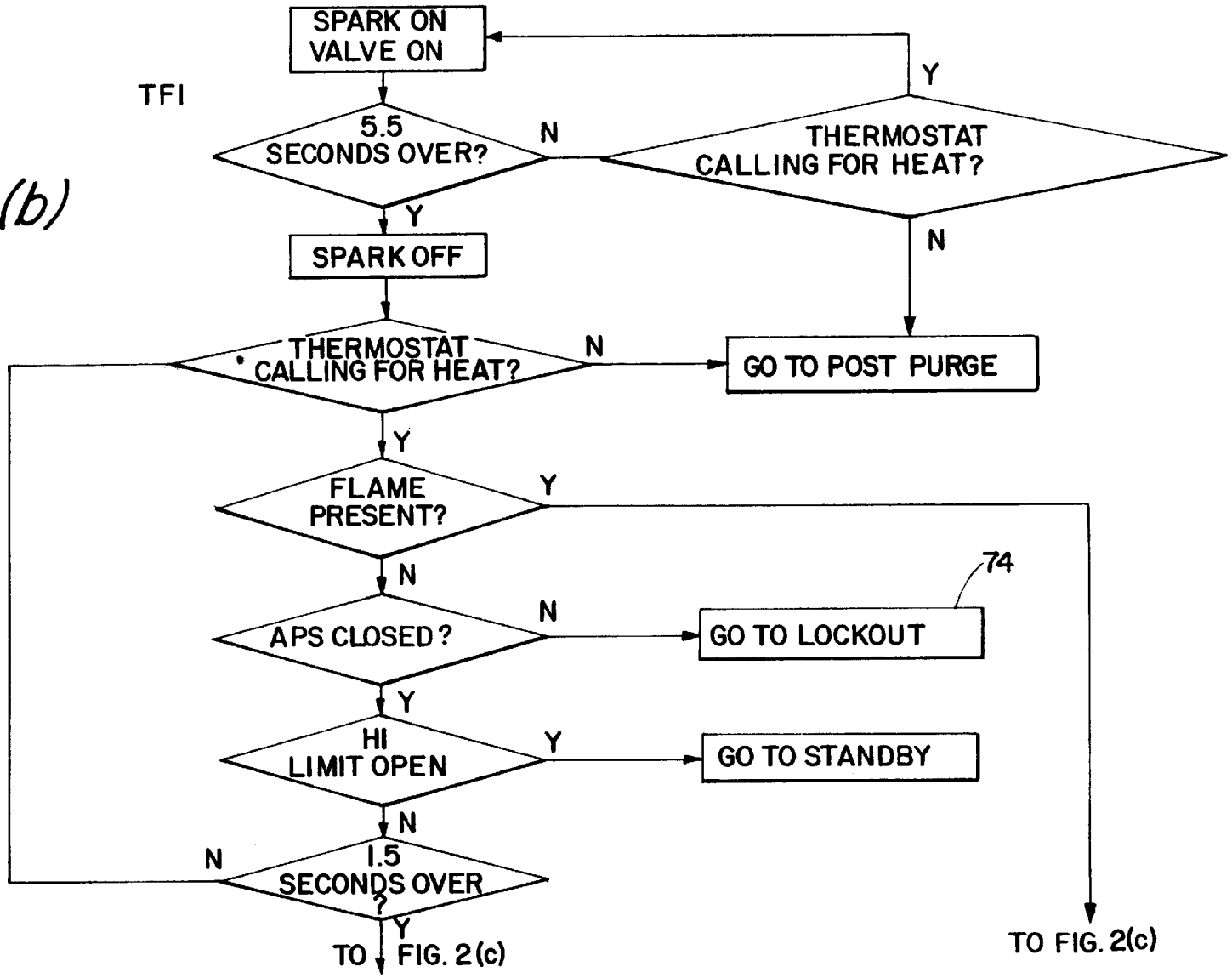
Figure 2C:
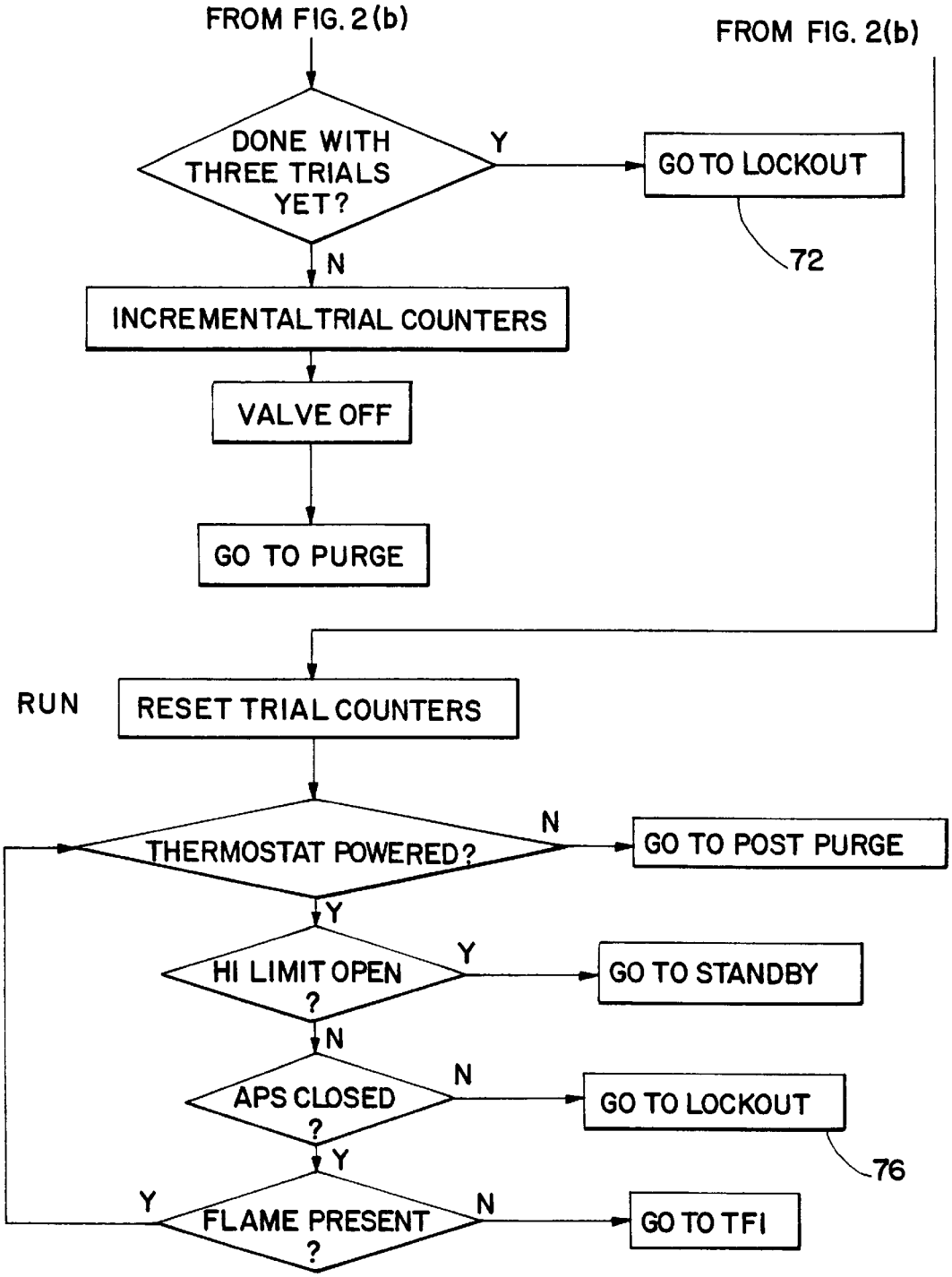

Referring now to FIG. 2 and 2*a*, a flow chart illustrating the various phases of operation of controller 14 and some of the diagnostic tests conducted therein are illustrated. As previously stated, during the stand-by phase of operation, the controller 14 performs a series of diagnostic tests to verify that the overall system is in operating order. With respect to diagnostic tests conducted during this phase of operation, if relay 16 and/or 20 are not operating properly the controller 14 will go into the lockout mode, illustrated by block 60, and cause the light emitting diode 34 to flash relatively rapidly at a pre-determined rate, such as 4 Hz. The 4 Hz pulse has a specific code "embedded" in a portion thereof, such as the trailing edge, for identification purposes so that the pulse can be attributed to a fault in the circuit for relay 16 and/or 20 when "read" by the code reading device 50 of the present invention. Furthermore, if the valve relay contact 18 is welded together in the normally open position, the controller 14 will go into the lockout mode, illustrated by block 62, and cause the light emitting diode 34 to flash relatively rapidly at a 4 Hz rate. Here again, the 4 Hz pulse will have another specific code "embedded" in a portion thereof, such as the trailing edge, for identification purposes. In addition to performing self-diagnostic tests, the controller 14 also monitors system faults. For example, if the solenoid valve 12 becomes open circuited, the controller 14 will go into the lockout mode, illustrated by block 64, and will again cause the light emitting diode 34 to flash relatively rapidly at a 4Hz rate with a specific code "embedded" in a portion thereof, such as the trailing edge, for identification purposes. In addition, if the high temperature limit switch 28 opens during any phase of operation, the controller 14 will actuate the relay 20 causing the closing of its associated contact 22 and the application of power to the fan 24 that provides combustion air to the burner, and the controller 14 will continuously monitor the state of the high temperature limit switch 28 and allow this switch 28 to re-close within a pre-determined period of time, such as ten (10) minutes. When the high temperature limit switch 28 re-closes, the controller 14 returns to the stand-by phase of operation. If the high temperature limit switch 28 fails to re-close within the aforementioned ten (10) minute period, the controller 14 will go into the lockout mode, illustrated by block 60, causing the light emitting diode 34 to flash relatively rapidly at a 4 Hz rate, as previously discussed. In addition, the controller 14 monitors the operating condition of air proving switch 26. If, for example, the air proving switch 26 is in the closed or "flow" position for more than a pre-determined period of time, such as five (5) seconds, after relay 20 is de-energized, thus indicating that the air proving switch 26 is stuck or welded in the closed position, the controller 14 will go into the lockout mode, illustrated by block 66, and cause the light emitting diode 34 to flash relatively rapidly at a 4 Hz with a specific code "embedded" in a portion thereof, such as the trailing edge, for identification purposes.

As previously stated, during the purge phase of operation, the controller 14 verifies that the solenoid valve 12 is de-energized, the high temperature limit switch 28 and the air proving switch 26 are closed and a flame is not present at the burner. With respect to self-diagnostic tests during this phase of operation, if power is being applied to the solenoid valve 12, the controller 14 will go into the lockout mode, illustrated by block 68, and cause the light emitting diode 34 to flash relatively rapidly at a 4 Hz rate with a specific code "embedded" in a portion thereof, such as the trailing edge, for identification purposes. As for system faults during this phase of operation, if the air proving switch 26 is in the open or "no flow" position when the relay 20 which controls the operation of fan 24 that provides combustion air to the burner is actuated, the controller 14 will go into the lockout mode, illustrated by block 70, and cause the light emitting diode 34 to flash at a relatively rapid rate, such as 4 Hz, with a specific code "embedded" in a portion thereof, such as the trailing edge, for identification purposes. Similarly, if the controller 14 detects the presence of flame at the burner during this phase of operation, the controller 14 will go into the aforementioned lockout mode, illustrated by block 70, causing the light emitting diode 34 to flash at a 4 Hz rate with a specific code "embedded" in a portion thereof, such as the trailing edge, for identification purposes.

During the trial for ignition phase of operation, if a flame is not established at the burner during the first ignition trial, the controller 14 will perform a second system purge cycle followed by a second ignition trial cycle. If a flame is still not established, a third system purge cycle followed by a third ignition trial cycle is performed. If a flame is not established during the third ignition trial cycle, the relay 20 for the combustion air fan 24 is de-energized and the controller 14 will enter the lockout mode, illustrated by block 72, causing the light emitting diode 34 to flash at a relatively slow rate, such as 1 Hz, with a specific code "embedded" in a portion thereof, such as the trailing edge, for identification purposes. Similarly, upon loss of flame at the burner, which could result from a gust of wind, the controller 14 will immediately perform another ignition trial cycle similar to the first ignition trial cycle. If a flame is not re-established during this ignition trial cycle, a purge cycle followed by a second ignition trial cycle and, if necessary, another purge cycle followed by a third ignition trial cycle are performed in an attempt to re-establish flame at the burner. If a flame is re-established during one of the ignition trial cycles, the controller 14 will return to the run phase of operation. If a flame is not re-established, the controller 14 will de-energize the relay 20 for the combustion air fan 24 and will go into the lockout mode, illustrated by block 72, and cause the light emitting diode 34 to flash relatively slowly at a 1 Hz rate, as previously discussed. Here again, if the air proving switch 26 is in the open or "no flow" position during this operating phase and relay 20 associated with the combustion air fan 24 is energized, thus indicating that the air proving switch 26 is in the closed position, the controller 14 will go into the lockout mode, illustrated by block 74, causing the light emitting diode 34 to flash at a relatively rapid rate, such as 4 Hz, with a specific code "embedded" in a portion thereof, such as the trailing edge, for identification purposes.

During the run phase of operation, the controller 14 monitors whether both the high temperature limit switch 28 and the air proving switch 26 are in the closed or "flow" position. If the air proving switch 26 is in the open or "no flow" position during this phase of operation, thus indicating that the fan 24 that provides combustion air to the burner is not operating or air proving switch 26 is inoperable, the controller 14 will go into the lockout mode, illustrated by block 76, and cause the light emitting diode 34 to flash at a relatively rapid rate, such as 4 Hz, with a specific code "embedded" in a portion thereof, such as the trailing edge, for identification purposes. In addition, if the flame is extinguished at the burner during this operating phase, the controller 14 will cause the initiation of the trial for ignition phase to re-establish the flame at the burner. Lastly, during the run phase of operation, the opening of thermostat contact 30 when the system reaches the desired temperature causes the controller 14 to de-energize relay 16 resulting in the opening of valve relay contact 18 causing the de-energization of solenoid valve 12. When the foregoing occurs, the controller 14 goes into the post-purge phase of operation. As previously stated, during the post-purge phase of operation, the controller 14 initiates a purge of the system for a pre-determined period of time, such as fifteen (15) seconds. During this operating phase, the controller 14 verifies that the solenoid valve 12 is de-energized, a flame is not present at the burner, and that the high temperature limit switch 28 and the air proving switch 26 are both in the closed position.

It should be noted that the aforementioned diagnostic tests are merely representative of the tests that can be performed by the present invention. The actual diagnostic tests that are performed are "tailored" to the specific burner application. Similarly, the frequency of the resulting flashes of the light emitting diode 34 and the code "embedded" therein can be customized to the specific application.

As previously stated, the code reading device 50 of the present invention is a battery-powered, hand-held device having a liquid crystal display 58 that provides the user with specific information as to the nature of a system fault indicated by one of the aforementioned lockout conditions. The housing for the code reading device 50 has an opening therein permitting the pulses produced by light emitting diode 34 to pass therethrough for interception by the optical sensor 52 therein. The optical sensor 52 intercepts the aforementioned pulses and circuitry is provided to "read" the code embedded therein for identification purposes. The "embedded" code is interpreted, translated by the microprocessor 54 and displayed as text on the liquid crystal display 58 thus enabling the user to readily diagnose system problems and/or malfunctions. In this manner the lockout conditions, which can be numerous, can be readily monitored and diagnosed by the code reading device 50.

Certain modifications and improvements will occur to those skilled in the art upon reading the foregoing. It should be understood that all such modifications and improvements have been deleted herein for the sake of conciseness and readability, but are properly within the scope of the following claims.

I claim:

1. Apparatus for controlling the operation of a solenoid valve in a gas fluid burner system including one or more components operatively connected together, said apparatus comprising controller means regulating the application of power to the solenoid valve and monitoring the occurrence of operating faults within said burner system, said controller means including means for sequentially verifying the operational status of said components and producing an output signal having a pre-determined frequency and having a code included in a portion thereof to identify a specific operating fault within said one or more of said components , each of said operating faults having a specific code assigned thereto for identification purposes and being detectable by an optical sensor, and means illuminated by said output signal produced by said controller means, said illumination means comprising a unitary light source.

2. The apparatus as defined in claim 1 further including means for monitoring the presence of a flame at the gas fired burner.

3. Apparatus for controlling the operation of a solenoid valve in a gas fired burner system including one or more components operatively connected together, said apparatus comprising controller means regulating the application of power to the solenoid valve and monitoring the occurrence of operating faults within said burner system, said controller means including means for sequentially verifying the operational status of said components and producing a signal having a pre-determined frequency and having a code included in a portion thereof to identify a specific operating fault within said one or more of said components, each of said operating faults having a specific code assigned thereto for identification purposes and being detectable by an optical sensor, means illuminated by said signal produced by said controller means, said illuminating means comprising a unitary light source, optical sensing means for determining the presence of said signal and producing an output in response thereto, means for processing said output of said sensing means and translating said code included in a portion of said signal and means for providing a display identifying said code included in a portion of said signal.

4. The apparatus as defined in claim 3 further including means for monitoring the presence of a flame at the gas-fired burner.

* * * * *

UNITED STATES PATENT AND TRADEMARK OFFICE

CERTIFICATE OF CORRECTION

PATENT NO. : 5,923,246

DATED : July 23, 1999

INVENTOR(S) : David K. Hartsfield

It is certified that error appears in the above-identified patent and that said Letters Patent is hereby corrected as shown below:

Column 2, line 7, change "FIG. 2 and 2a is" to

--- FIG. 2, 2a, 2b and 2c are ---

Column 4, line 22, change "FIG. 2 and 2a" to

--- FIG. 2, 2a, 2b and 2c ---

Signed and Sealed this

Fourteenth Day of March, 2000

*Attest:*

*Attesting Officer*

Q. TODD DICKINSON

*Commissioner of Patents and Trademarks*